US007441305B2

(12) United States Patent
Cascio

(10) Patent No.: US 7,441,305 B2
(45) Date of Patent: Oct. 28, 2008

(54) FLOOR CLEANER

(76) Inventor: Gregory R. Cascio, 3437 N. Hoyne, Chicago, IL (US) 60618

( * ) Notice: Subject to any disclaimer, the term of this patent is extended or adjusted under 35 U.S.C. 154(b) by 0 days.

(21) Appl. No.: 11/499,577

(22) Filed: Aug. 4, 2006

(65) Prior Publication Data

US 2008/0028570 A1 Feb. 7, 2008

(51) Int. Cl.
*A47L 9/02* (2006.01)

(52) U.S. Cl. ..... 15/351; 15/416

(58) Field of Classification Search ..... 15/351, 15/146, 418, 419, 415.1, 422.1
See application file for complete search history.

(56) References Cited

U.S. PATENT DOCUMENTS 3,597,903 A 8/1971 Schaaf
4,023,234 A * 5/1977 Martinec et al. ..... 15/331
4,055,870 A 11/1977 Furutsutsumi
5,123,141 A 6/1992 Erickson et al.
5,477,585 A 12/1995 Hentzschel et al.
5,987,700 A 11/1999 Edlund
6,039,817 A * 3/2000 Payne ..... 134/21
6,277,164 B1 8/2001 Embree et al.
7,124,467 B2 * 10/2006 Hitzelberger et al. ..... 15/416
2003/0188396 A1 * 10/2003 Hitzelberger et al. ..... 15/351

* cited by examiner

*Primary Examiner*—David B Thomas
(74) *Attorney, Agent, or Firm*—James P. Muraff; Neal, Gerber & Eisenberg LLP

(57) ABSTRACT

The invention is directed to a floor cleaner apparatus, such as a vacuum cleaner, including a housing have a particle retaining element and a head operably connected to the housing. The head features an intake port through which dirt and other particles enter the head and a motor and fan assembly that creates suction during operation. A passageway or duct extends between the intake port through the motor and fan assembly. Within the duct, an internal divider forms a plurality of discrete intake chambers wherein each chamber is in fluid communication with the intake port. A beater element, such as a rotatable cylinder with a brush, is positioned above the intake port and proximate the intake chambers. A chamber control mechanism is provided to sequentially apply suction through the various intake chambers to both focus and increase the suction applied to the floor and thereby increase the amount of dirt and particles removed by the cleaner.

20 Claims, 6 Drawing Sheets

FLOOR CLEANER

CROSS-REFERENCE TO RELATED APPLICATIONS

N/A

FEDERALLY SPONSORED RESEARCH OR DEVELOPMENT

N/A

TECHNICAL FIELD

The invention relates to an improved floor cleaner that applies suction sequentially through internal intake channels to the floor to draw a greater amount of dirt and/or debris into the cleaner. More specifically, the invention provides a floor cleaner, such as a vacuum cleaner, with a plurality of discrete intake chambers in communication with an intake port, whereby suction is applied through each intake chamber in a controlled manner to increase the suction applied to the floor.

BACKGROUND OF THE INVENTION

Floor cleaners, including vacuum cleaners for both carpets and hard surfaces such as tile and wood, are well known in the art. Carpet (floor) shampoo extractors and cleaners are also well known. While such conventional floor cleaners provide a number of beneficial features, they nevertheless have certain limitations. An example of an existing floor cleaner is disclosed in U.S. Pat. No. 5,123,141 to Erickson et al. There, an accessory cleaning tool 10 is attachable to a flexible hose of a conventional vacuum cleaner, wherein the tool 10 includes a T-shaped housing 12 with an internal V-shaped manifold 20 having outward end openings 22. Each end openings 22 is aligned with an opening 40 in the lower plate 34 of the tool 10. Suction is applied to the surface to be cleaned through only the pair of openings 22, 40 and as result, debris is drawn into the head 10 and the manifold 20 through only the two openings 22, 40. Consequently, the application of suction is limited to two finite locations, wherein dirt and debris residing between the openings 22, 40 are not drawn into the manifold 20 and the tool 10.

The present invention is provided to solve the limitations of conventional containers discussed above and other problems, and to provide advantages and aspects not provided by prior floor containers of this type. A full discussion of the features and advantages of the present invention is deferred to the following detailed description, which proceeds with reference to the accompanying drawings.

SUMMARY OF THE INVENTION

The present invention is directed to a floor cleaner apparatus including a housing and a head operably connected to the housing. The housing includes an internal particle retaining element, such as a disposable bag, that receives dirt and/or debris drawn into the apparatus. The head includes a motor and fan assembly that creates a pressure gradient resulting in a partial vacuum during operation of the cleaner. The head further includes a rotatable beater element and an intake port positioned in a lower portion of the head below the beater element. An intake assembly is positioned within the head and extends between the intake port and the particle retaining element.

According to another aspect of the invention, a divider assembly partitions the intake assembly into a plurality of discrete intake chambers, wherein each chamber is in fluid communication with the intake port. Each intake chamber defines a particle transmission passageway extending from the intake port through the intake assembly and to the particle retaining element. The head includes a chamber control mechanism that sequences the suction applied to the intake chambers in order to focus the suction through the intake port. In one embodiment, the chamber control mechanism is a gate valve assembly that includes a plurality of gate members and cams, wherein each gate is operably associated with an intake chamber. The gate is moveable between an open position wherein the intake chamber is open to allow for suction to pass through that intake chamber and the intake port, and a closed position wherein the intake chamber is closed to prevent suction from passing through that intake chamber and the intake port. In another embodiment, the chamber control mechanism is a rotating turret assembly with a plate having at least one opening cooperatively dimensioned with the intake channels. In an open position, the opening is aligned with one of the intake chambers to allow for suction through that intake chamber. While one of the intake chambers is in the open position, the other intake chambers are aligned with the plate to provide a closed position.

According to a default operational mode of the invention, the operator utilizes a switch on the housing to operate the cleaner in a conventional manner wherein the chamber control mechanism is inactive and suction is applied through all intake chambers to draw dirt and debris into the intake port and the intake assembly. When the operator actuates the switch from the default mode to the activated mode, the chamber control mechanism is activated to sequentially apply suction through the various intake chambers. In a first position, the gate member associated with one of the intake chambers is in the open position whereby suction extends through that intake chamber for a first time interval. Once the first time interval is completed, a second position occurs where the gate member associated with another intake chamber is in the open position whereby suction extends through that intake chamber for a second time interval. After the second time interval is completed, a third position occurs where the gate member associated with yet another intake chamber is in the open position whereby suction extends through that intake chamber for a third time interval. The sequential application of suction through the remaining intake chambers occurs in a similar manner until the suction is applied to the last intake chamber, wherein the sequence repeats with the first position.

The switch mentioned above can be a multi-position switch wherein a first position can be an "off" position (open circuit), a second position can be an "on" position (closed circuit) where no sequencing or alternating of the intake chambers occurs (all are open), a third position (closed circuit) can be when a first group (such as half) of the intake chambers are in an open position at the same time and then a second group of intake chambers (such as the other half) are in an open position and the first group of intake chambers are closed within the sequencing and continued alternating of the groups. A fourth switch position can be normal or maximum operation of sequencing with each individual intake chamber being alternately sequenced (open and closed), with overlap in one embodiment, as described herein. Any combination of the above switch positions can be provided in a multi-position switch arrangement. A controller with software and an LCD, touch screen, or other interface can also be provided for digital control of the various possible operations of the present invention, instead of or in addition to a multi-position switch.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
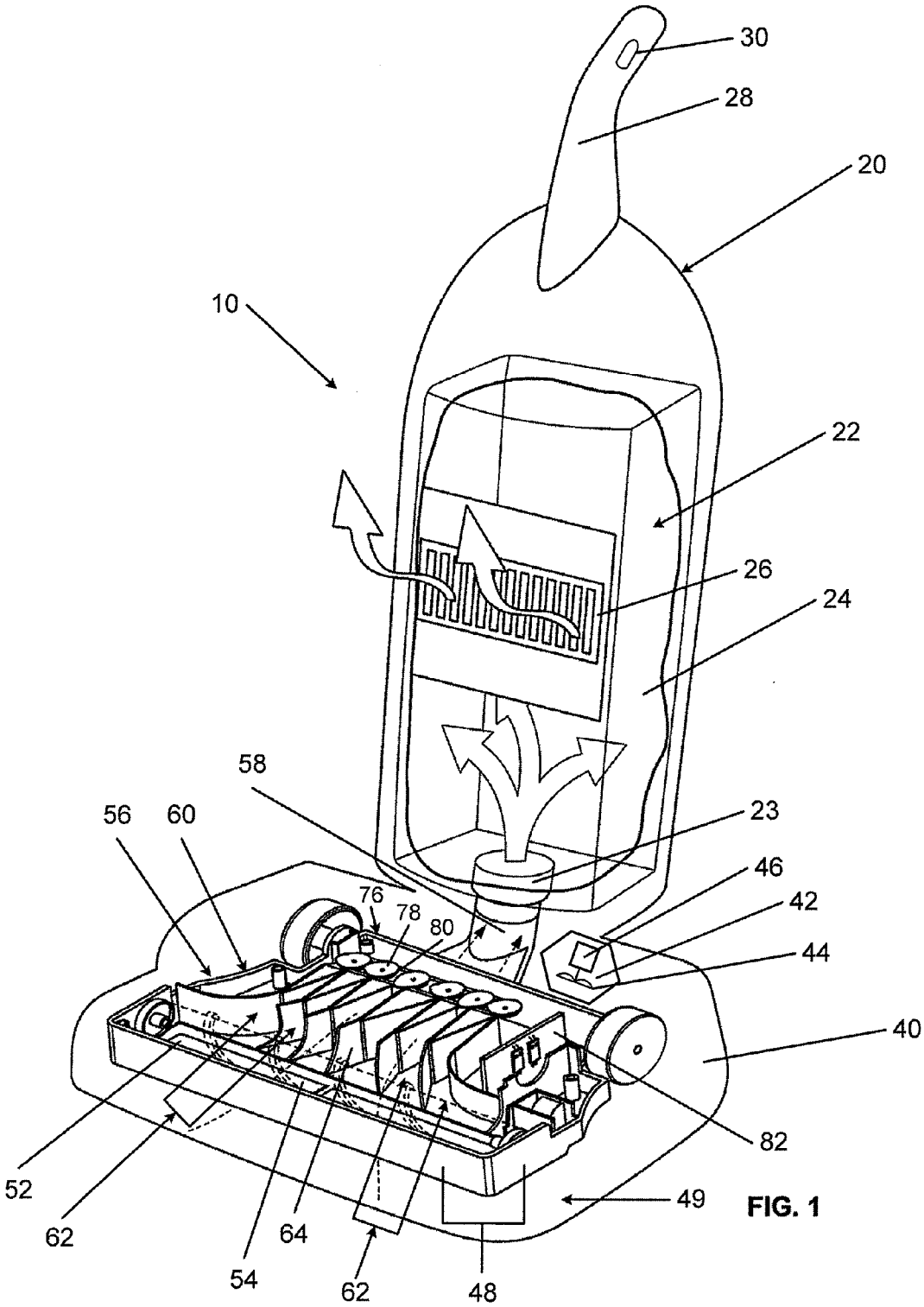
FIG. 1 is a cut-away perspective view of a floor cleaner of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Structure

A floor cleaner apparatus 10 is shown in FIGS. 1-6. The cleaner apparatus 10 may be a vacuum cleaner configured to clean carpet or a variety of hard flooring, such as wood, tile and marble. The floor cleaner can also be a carpet cleaner, such as a vacuum cleaner for carpet, or such as a shampoo carpet cleaner or carpet extractor. Although shown in the Figures as an "upright" vacuum cleaner, the cleaner 10 may be of the "canister" type. In broad terms, the cleaner apparatus 10 includes a housing 20 and a head 40 operably connected to the housing 20. The housing 20 includes an internal particle retaining element 22 that receives dirt and/or debris drawn into the apparatus 10. In the embodiment of FIG. 1, the particle retaining element 22 is a disposable bag 24 with an integrated exhaust vent 26. In another embodiment of the cleaner apparatus 10 (not shown) that creates an internal vortex of air, the retaining element 22 is a removable vessel or cup that can be reused after being emptied of dirt and debris, or dirty water, as appropriate for the applicable embodiment. The housing 20 further includes a handle 28 and a switch 30 that an operator actuates to control operation of the cleaner 10.

Figure 2:
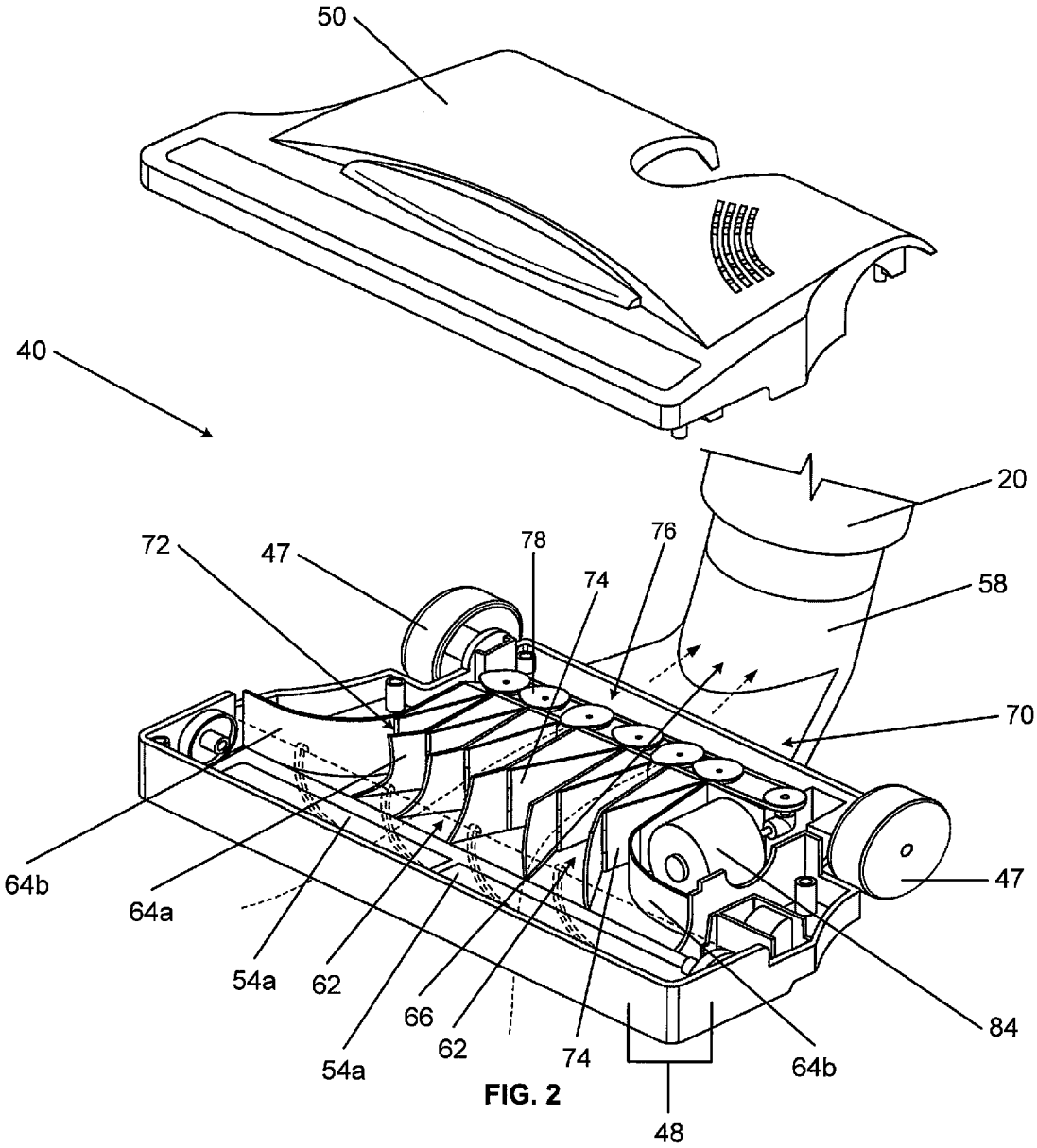
FIG. 2 is an exploded view of the floor cleaner, showing a head portion of the cleaner and a plurality of discrete intake chambers.

The head 40 includes a motor and fan assembly 42 with a fan 44 and an electric motor 46 that creates a pressure gradient resulting in a partial vacuum during operation of the cleaner 10. The head 40 includes a plurality of wheels 47 and a wall arrangement 48 that defines a compartment 50 of the head 40. The head 40 further includes a rotatable beater element 52 and an intake port 54 positioned in a lower portion of the head 40 below the beater element 52. The beater element 52 is operably connected to the motor 46 and when rotated, agitates carpet to dislodge dirt and debris for suction into the cleaner 10. When the cleaner 10 is configured as a dedicated floor vacuum, the beater element 52 may be omitted from the head 40. The intake port 54 is the lower opening in the compartment 50 through which dirt and debris are draw into the head 40. Although FIGS. 1 and 2 show the head 40 as having two adjacent intake ports 54, the head 40 can have a single intake port 54 that extends substantially the width of the head 40. An intake assembly 56 is positioned within the head 40 and extends between the intake port 54 and the particle retaining element 22. As such, the intake assembly 56 comprises the intake port 54, the motor and fan assembly 42 and a neck 58 extending to the particle retaining element 22. Preferably, the neck 58 couples with an interface element 23 of particle retaining element 22 to ensure an air-tight connection with the particle retaining element 22.

A divider assembly 60 partitions the intake assembly 60 into a plurality of discrete intake chambers 62, wherein each chamber 62 is in fluid communication with the intake port 54*a*. In the configuration where the intake assembly 56 includes only two intake chambers 62, a single divider wall 64 internally partitions the intake passageway into a first intake chamber 62 and an adjoining second intake chamber 62. In the configuration shown in FIGS. 1 and 2, the intake assembly 60 includes six intake chambers 62 resulting from a plurality of internal dividers 64*a* and a pair of external dividers 64*b*. Each intake chamber 62 defines a particle transmission passageway 66 extending from the intake port 54 through the intake assembly 56 and to the particle retaining element 22. In one embodiment, the plurality of intake chambers 64*a* can extend to the inside wall of the wall arrangement 48, and can surround or substantially surround the beater element 54 for better separation of intake chambers 62 in relation to the intake ports 54*a*. Accordingly, the multiple intake chambers 62 provide multiple particle transmission passageways 66, wherein suction flows through one or more passageways 66 to draw dirt and debris into the head 40. To focus the suction, each intake chamber 62 has a proximal or leading edge portion that is preferably positioned adjacent the beater element 54 and/or the intake ports 54*a*. Similarly, each divider wall 64 has a proximal or leading edge portion that is preferably positioned adjacent the beater element 54 and/or the intake ports 54*a*. Each intake chamber 62 and each divider wall 64 has a distal or trailing edge portion that extends substantially into the intake assembly 60 towards a rear portion of the head 40 near the fan and motor assembly 42.

To control the application of suction through the various intake chambers 62, the head 40 includes a chamber control mechanism 70. In general terms, the chamber control mechanism 70 sequences the suction applied to the intake chambers 62 in order to focus the suction through the intake port 54. The operation of the chamber control mechanism 70, including the sequencing is discussed in greater detail below. The switch 30 is operably connected to the chamber control mechanism 70, such that the operator can selectively operate the cleaner 10 in a standard or default mode, where suction is applied through all intake chambers 62, or an activated mode where the chamber control mechanism 70 is sequencing suction through the intake chambers 62.

Figure 3:
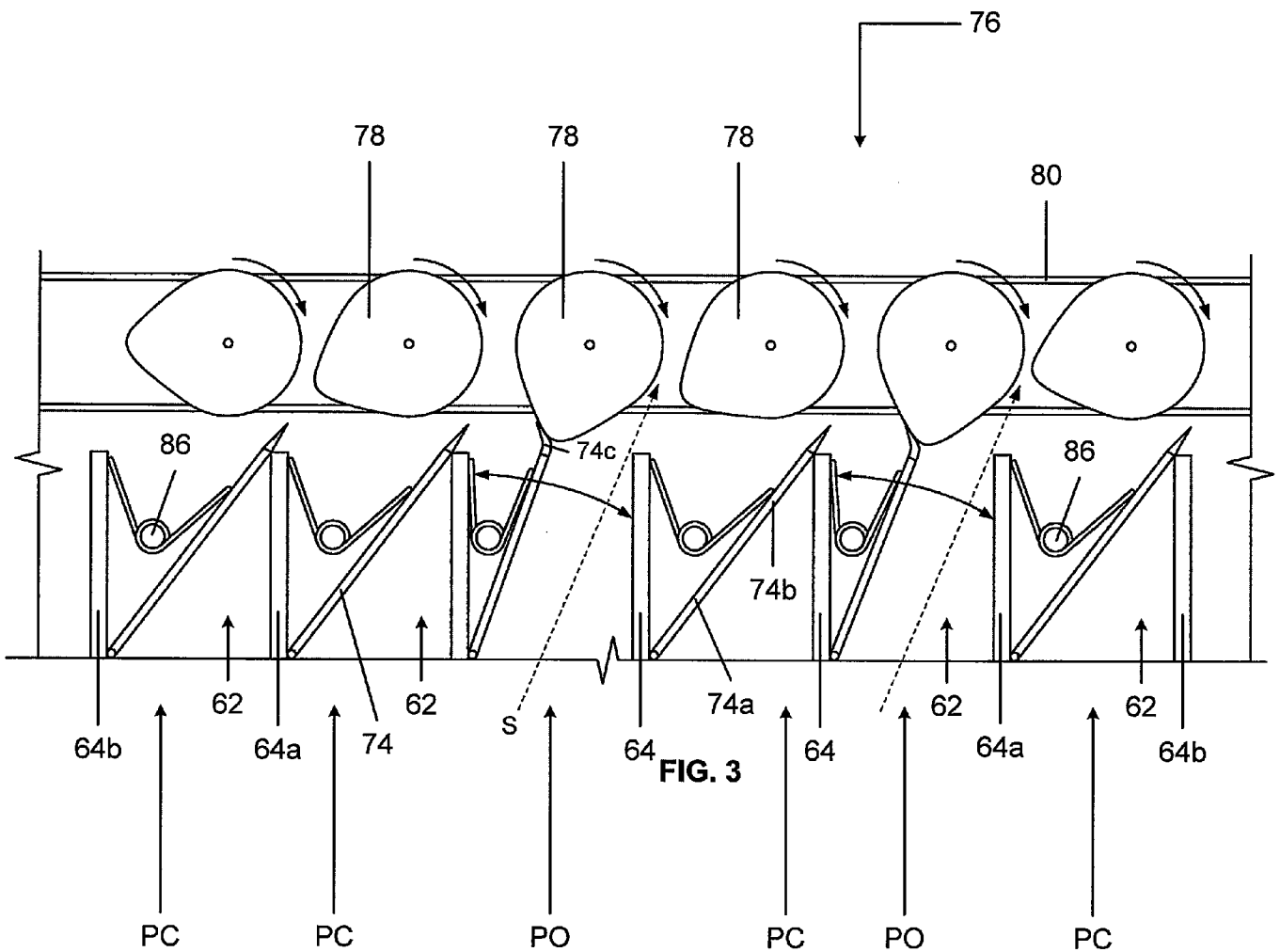
FIG. 3 is a schematic view of the floor cleaner, showing the intake chambers and a chamber control mechanism.

In the embodiment of FIGS. 1-3, the chamber control mechanism 70 includes a gate valve assembly 72 that includes a plurality of gate members 74, wherein each gate 74 is operably associated with an intake chamber 62. The gate 74 is moveable between an open position Po (see FIG. 3) wherein the intake chamber 64 is open to allow for suction to pass through that intake chamber 62 and the intake port 54, and a closed position Pc (see FIG. 3) wherein the intake chamber 62 is closed to prevent suction from passing through that intake chamber 62 and the intake port 54. The chamber control mechanism 70 also includes a cam assembly 76 comprising a plurality of cams 78 and a flexible belt 80 that drives the cams 78. Each cam 78 is associated with a gate 74 at a distal end of the intake chamber 62. In the embodiment of FIG. 1, the belt 80 is operably connected to a microelectronic controller 82 that is linked to the switch 30 in the handle 28. In the embodiment of FIG. 2, the belt 80 is operably connected to a separate motor 84 that is also linked to the switch 30. Referring to FIG. 3, a first end 74*a* of the gate 74 is pivotally connected to a divider wall 64, while a second gate end 74*b* is positioned proximate the cam 78 such that the gate 74 can be engaged and actuated by the cam 78 between the open and closed positions Po, Pc. The second end 74*b* may include an extension tip 74*c* to facilitate engagement with the cam 78. The extension tip 74*c* is fabricated from a resilient polymer to increase the durability and operational life of the gate 74. A spring 86 biases the gate towards the closed position Pc once the cam 78 has disengaged the second gate end 74*b*. In the closed position Pc, the gate 74 makes contact with the other divider wall 64 that defines the intake chamber 62 whereby said contact effectively seals the intake chamber 62 to prevent suction S through that intake chamber 62. In the open position Po, the gate 74 is positioned an appreciate distance from the other divider wall 64 that defines the intake chamber 62 whereby said contact allows for suction S through that intake chamber 62. In FIG. 3, two intake chambers 62 are in the open position Po and four intake chambers 62 are in the closed position Pc.

Figure 5:
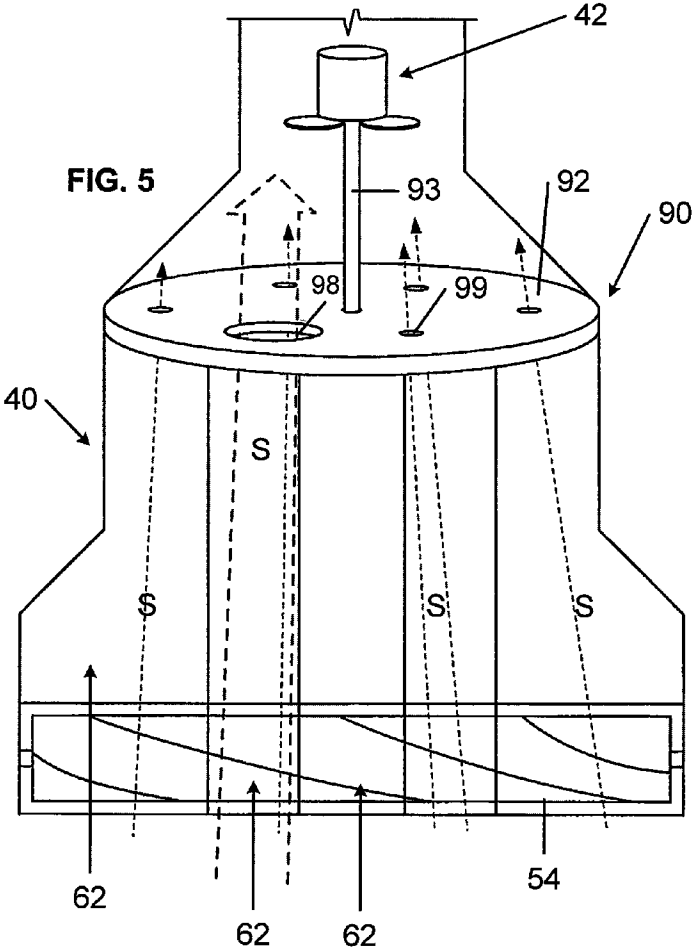
FIG. 5 is a schematic view of the floor cleaner, showing a second alternate version of the chamber control mechanism; and, FIGS. 6 A-F are schematic views of the floor cleaner, reflecting the operation of the chamber control mechanism and the sequential application of suction.
Figure 4:
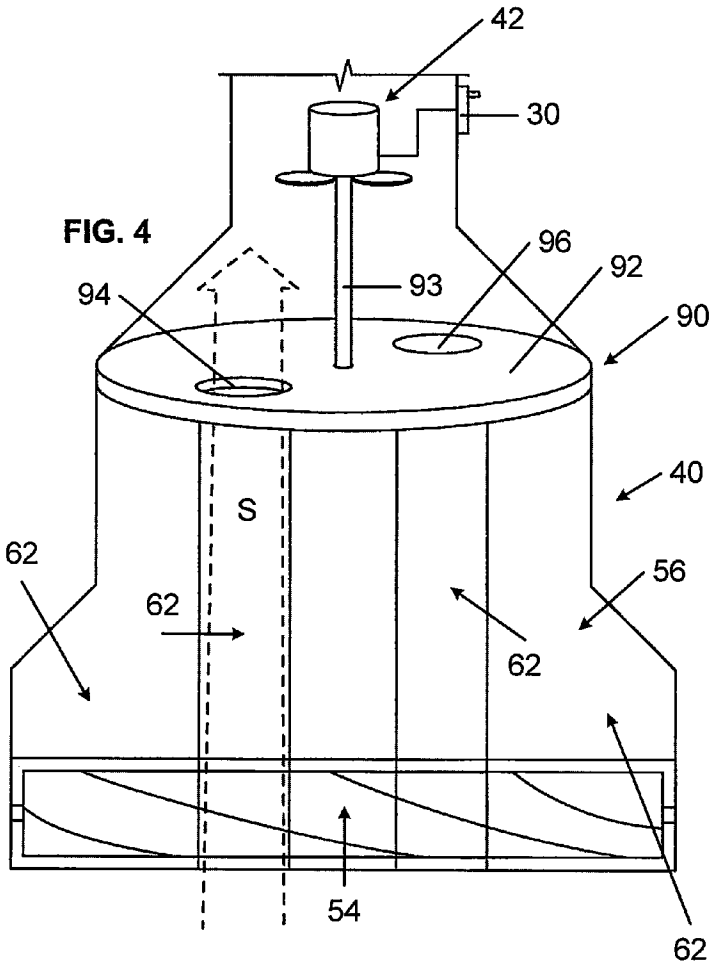
FIG. 4 is a schematic view of the floor cleaner, showing a first alternate version of the chamber control mechanism.

In the embodiment of FIGS. 4 and 5, the chamber control mechanism 70 is a rotating turret assembly 90 having a plate 92 with at least one opening 94 cooperatively dimensioned with the intake channels 62 and a blank 96. In an open position Po, the opening 94 is aligned with one of the intake chambers 62 to allow for suction S through that intake chamber 62. While one of the intake chambers 62 is in the open position Po, the other intake chambers 62 are aligned with the plate 92 to provide a closed position Pc for those intake chambers 62. The turret assembly 90 is connected to the fan and motor assembly 42 by a shaft 93. Referring to FIG. 5, in another version of the chamber control mechanism 70 the turret assembly 90 includes a plate 92 with a larger primary opening 98 and a plurality of secondary openings 99, wherein the primary opening 98 is aligned with one of the intake channels 62 and the secondary openings 99 are each aligned with other intake chambers 62. The alignment provided by the primary opening 98 provides for a greater amount of suction S through the intake chamber 62 compared to the suction S resulting from alignment of the secondary openings 99 with the other intake chambers 62.

Operation

As mentioned above, during operation the fan 44 turns and forces air towards the exhaust port 26, whereby the density of particles and therefore the air pressure increases in front of the fan 44 and decreases behind the fan 44. Because the pressure level in the area behind the fan 44 drops below the pressure level outside the cleaner 10 (the ambient air pressure), suction or a partial vacuum, is created within the cleaner 10. The ambient air is drawn into the cleaner 10 through the intake port(s) 54 due to the fact that the air pressure inside the cleaner 10 is lower than the pressure outside. As long as the fan 44 is operating and the passageway through the intake chambers 62 remain open, there is a constant stream of air moving through the intake assembly 60 and to the particle retaining element 22 (and out the exhaust vent 26). The application of suction through the intake chambers 62 is controlled by the chamber control mechanism 70 to sequentially focus suction through each intake chamber 62 for a discrete time period, which may range from a millisecond to a second. Thus, the complete suction cycle, which corresponds to the amount of time necessary to sequentially apply suction to all intake chambers 62, is a function of many factors, including the number of intake chambers 62, the time duration of suction applied to each chamber 62, and the operational speed of the control mechanism 70. Preferably, the complete suction time cycle occurs so rapidly that the operator cannot perceive the sequential application of suction.

In the standard or default mode, the operator utilizes the switch 30 to operate the cleaner 10 in a conventional manner wherein the chamber control mechanism 70 is inactive and suction is applied through all intake chambers 62 to draw dirt and debris into the intake port 54 and the intake assembly 56. In the default mode, all gate members 74 are in the open position. When the operator actuates the switch 30 from the default mode to the activated mode, the chamber control mechanism 70 is activated to sequentially apply suction through the various intake chambers 62. Schematic FIGS. 6A-D utilize the gate valve assembly 72 to provide an example of the suction progression through an intake assembly 56 having six discrete intake chambers 62. In a first position P1 shown in FIG. 6A, the gate member 72 associated with the third intake chamber 62 (from the left side of the head 40) is in the open position whereby suction S (represented by the arrows) extends through that intake chamber 62 for a first time interval. The gate member 72 associated with the other intake chambers 62 remains closed in the first position P1. Once the first time interval is completed, a second position P2 (see FIG. 6B) occurs where the gate member 72 associated with the second intake chamber 62 is in the open position whereby suction S extends through that intake chamber 62 for a second time interval. Again, the gate member 72 associated with the other intake chambers 62 remains closed in the second position P2. After the second time interval is completed, a third position P3 (see FIG. 6C) occurs where the gate member 72 associated with the fifth intake chamber 62 is in the open position whereby suction S extends through that intake chamber 62 for a third time interval. Once the third time interval is completed, a fourth position P4 (see FIG. 6D) occurs where the gate member 72 associated with the sixth intake chamber 62 is in the open position whereby suction S extends through that intake chamber 62 for a fourth time interval. Of course, the gate members 72 associated with the other intake chambers 62 remain closed in the third and fourth positions P3, P4. The sequential application of suction S through the remaining intake chambers 62—the first and fourth chambers 62—occurs in a similar manner to define a fifth position P5 and a sixth position P6. After the sixth time interval associated with the sixth position P6 is completed, the sequence repeats with the first position P1. Alternatively, the sequence can include a purge position (not shown), similar to the default mode, where all gate members 72 are open and suction S is applied to all of the intake chambers 64 prior to the first position P1 of the next suction cycle.

Figures 6A, 6B, 6C, 6D:
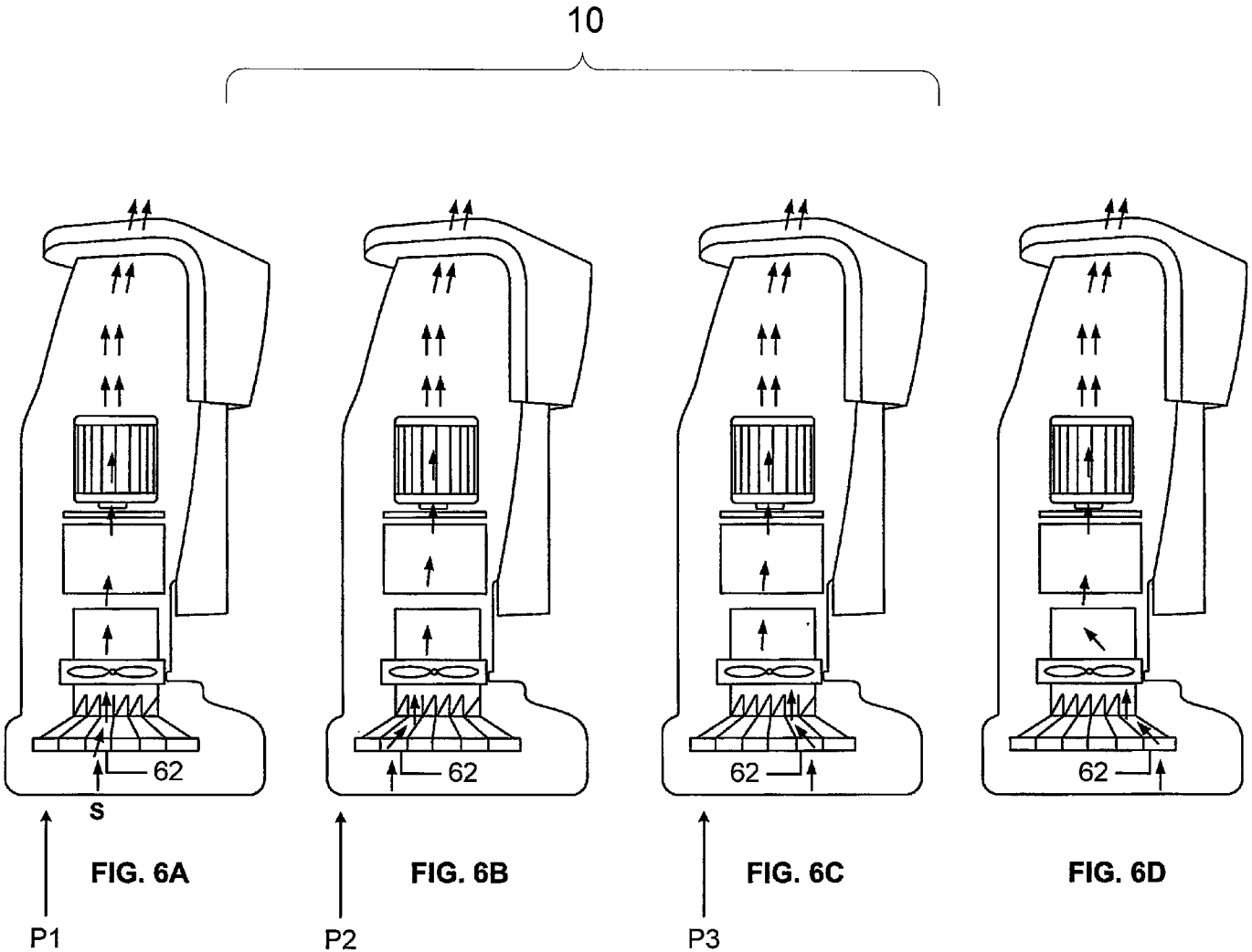
Figures 6E, 6F:
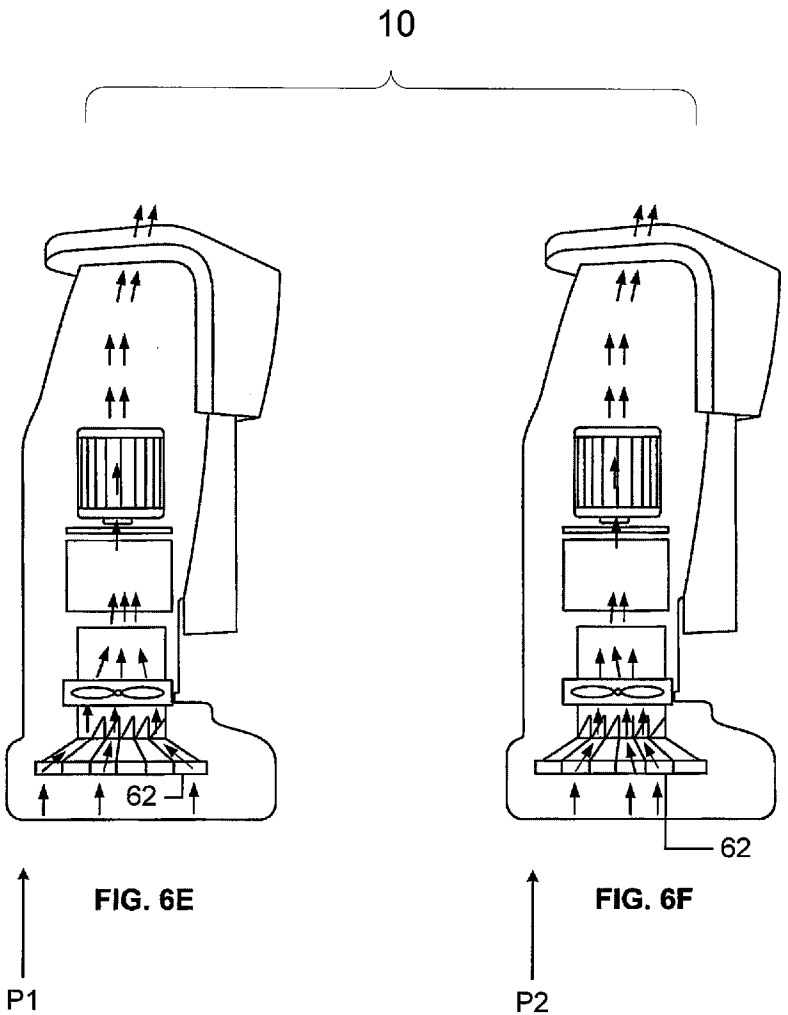

Schematic FIGS. 6E and 6F provide another example of the suction progression through an intake assembly 56 having six discrete intake chambers 62 where suction is applied through multiple chambers 62 at the same time. In a first position P1 shown in FIG. 6E, the gate member 72 associated with each of the first, third and sixth intake chambers 62 is in the open position whereby suction S (represented by the arrows) extends through each of those intake chambers 62 for a first time interval. While the gate member 72 associated with the first, third and sixth intake chambers 62 are open, the gate member 72 associated with the other intake chambers 62 remain closed in the first position P1. Once the first time interval is completed, a second position P2 (see FIG. 6F) occurs where the gate member 72 associated with each of the second, fourth and fifth intake chambers 62 are in the open position whereby suction S extends through each of intake chamber 62 for a second time interval. After the second time interval is completed, the sequence repeats with the first position P1. Alternatively, the sequence can include a purge position (not shown), similar to the default mode, where all gate members 72 are open and suction S is applied to all of the intake chambers 64 prior to the first position P1 of the next suction cycle. Compared to the first example provided in the foregoing paragraph where suction S is sequentially applied to each and every intake chamber 62, the second example of this paragraph illustrates the application of suction to a group of intake chambers 62, which thereby provides suction to a larger extent of the intake port 54.

In one embodiment, once the operator releases the switch 30, the cleaner 10 returns automatically from the activated mode to the default mode. In another embodiment, the operator must actuate the switch 30 from the activated mode to the default mode to cease the sequential application of suction provided during the activated mode. In yet another embodiment, the switch 30 includes a chamber selection feature for the activated mode, wherein the operator actuates the switch 30 to select a single intake chamber 62 or small group of chambers 62 to apply suction there through. For example, the operator may actuate the switch 30 to focus suction through the third intake chamber 62 or the third and fourth intake chambers 62 to remove a significant amount of floor debris residing external to those chambers 62. The head 40 may have indicia proximate the various intake chambers 62 such that the operator can determine the location of the floor debris relative to the intake chambers 62.

While the specific embodiments have been illustrated and described, numerous modifications come to mind without significantly departing from the spirit of the invention, and the scope of protection is only limited by the scope of the accompanying Claims.

What is claimed is:

1. A floor cleaner apparatus comprising:

a housing have a particle retaining element;

a head operably connected to the housing, the head having a motor and a suction assembly that creates suction during operation of the cleaner apparatus, and an intake port; and, the head further having an internal divider that forms a plurality of discrete intake chambers wherein each chamber is in fluid communication with the intake port, the head further having a chamber control mechanism that, when activated, automatically applies suction through the various intake chambers in a predetermined sequence while the cleaner apparatus is operating.

2. The floor cleaner of claim 1, further comprising a beater element positioned above the intake port, wherein the beater element is a rotatable cylinder with a brush.

3. The floor cleaner of claim 1, wherein the chamber control mechanism is a gate valve assembly moveable between a default position wherein all of the intake chambers are open to allow for suction through the intake port, and an activated position wherein one intake chamber is open to allow for suction through the intake port while the remaining intake chambers are closed to prevent suction there through.

4. The floor cleaner of claim 1, wherein the chamber control mechanism is a rotating turret assembly having a plate with at least one opening, wherein in an activated position the opening is aligned with an intake chamber to allow for suction through the intake port.

5. A floor cleaner apparatus comprising:

a housing have a particle retaining element;

a head operably connected to the housing, the head having a motor and a suction assembly that creates suction during operation of the cleaner apparatus, and an intake port; and, the head further having an internal divider that forms a plurality of discrete intake chambers wherein each chamber is in fluid communication with the intake port, the head further having a chamber control mechanism that sequentially applies suction through the various intake chambers;

wherein the head includes a duct extending between the intake port through the motor and suction assembly, and wherein the intake chambers are positioned within the duct.

6. The floor cleaner of claim 5, wherein each intake chamber extends inward from the intake port to an intermediate portion of the duct.

7. A floor cleaner apparatus comprising:

a housing having a particle retaining element;

a head operably connected to the housing, the head having a motor and a suction assembly that creates suction during operation of the cleaner apparatus, and an intake port; and, the head further having an internal divider that forms a plurality of discrete intake chambers wherein each chamber is in fluid communication with the intake port, the head further having a chamber control mechanism that sequentially applies suction through the various intake chambers; wherein the head includes a duct extending between the intake port through the motor and suction assembly, wherein the intake chambers are positioned within the duct, wherein each intake chamber extends inward from the intake port to an intermediate portion of the duct, wherein the internal divider is positioned between a pair of intake chambers, and wherein the divider extends inward from a proximal end of the intake chambers near the intake portion to a distal end of the intake chambers adjacent the intermediate duct portion.

8. A floor cleaner apparatus comprising:

a housing have a particle retaining element;

a head operably connected to the housing, the head having a motor and a suction assembly that creates suction during operation of the cleaner apparatus, and an intake port; and, the head further having an internal divider that forms a plurality of discrete intake chambers wherein each chamber is in fluid communication with the intake port, the head further having a chamber control mechanism that sequentially applies suction through the various intake chambers;

wherein the chamber control mechanism is a gate valve assembly moveable between a default position wherein all of the intake chambers are open to allow for suction through the intake port, and an activated position wherein one intake chamber is open to allow for suction through the intake port while the remaining intake chambers are closed to prevent suction there through; and wherein the chamber control mechanism includes a gate element for each intake chamber that allows for movement between the default and activated positions.

9. A floor cleaner apparatus comprising:

a housing have a particle retaining element;

a head operably connected to the housing, the head having a motor and a suction assembly that creates suction during operation of the cleaner apparatus, and an intake port; and, the head further having an internal divider that forms a plurality of discrete intake chambers wherein each chamber is in fluid communication with the intake port, the head further having a chamber control mechanism that sequentially applies suction through the various intake chambers;

wherein the chamber control mechanism is a gate valve assembly moveable between a default position wherein all of the intake chambers are open to allow for suction through the intake port, and an activated position wherein one intake chamber is open to allow for suction through the intake port while the remaining intake chambers are closed to prevent suction there through; and wherein the chamber control mechanism includes a flexible belt operably connected to the motor and fan assembly and a cam assembly operably connected to the belt, wherein the cam assembly sequentially engages the gate elements.

10. A vacuum cleaner apparatus comprising:

a housing having a particle retaining element;

a head operably connected to the housing, the head having:

a motor and fan assembly that creates suction during operation;

an intake assembly in fluid communication with the motor and fan assembly, the intake assembly including an intake port positioned in a lower portion of the head below the beater element;

a divider assembly that partitions the intake assembly into at least two discrete intake chambers wherein each chamber is in fluid communication with the intake port; and, a chamber control mechanism that, when activated, automatically selectively applies suction to the at least two intake chambers in a predetermined sequence during operation of the vacuum cleaner apparatus, whereby exterior particles are drawn through the intake port and into the intake assembly for capture by the particle retaining element.

11. The vacuum cleaner apparatus of claim 10, wherein the chamber control mechanism is moveable between a first position wherein suction is applied to one of the intake chambers, a second position wherein suction is applied to the other of the intake chambers, and a closed position wherein suction is prevented from being applied to either intake chamber.

12. The vacuum cleaner apparatus of claim 11, wherein the chamber control mechanism is moveable to a third position wherein suction is applied to both of the intake chambers.

13. The vacuum cleaner apparatus of claim 11, wherein the housing includes an switch operably connected to the chamber control mechanism, wherein the switch enables the operator to selectively choose between the fast and second open positions and the closed position.

14. The vacuum cleaner apparatus of claim 10, wherein the intake assembly includes a particle transmission passageway extending from the intake port through the intake channels and to the particle retaining element.

15. The vacuum cleaner of claim 10, wherein the chamber control mechanism is a gate valve assembly moveable between an open position wherein at least one of the intake chambers is open to allow for suction through the intake port, and a closed position wherein at least one of the intake chambers is closed to prevent suction through the intake port.

16. The vacuum cleaner of claim 10, wherein the chamber control mechanism is a rotating turret assembly having a plate with at least one opening, wherein in an open position the opening is aligned with one of the intake chambers to allow for suction through that intake port.

17. A vacuum cleaner comprising:

a housing have a particle retaining element; and a suction head assembly in communication with the particle retaining element and creating suction during operation of the vacuum cleaner, the suction head assembly including an intake port and an internal divider that forms a plurality of discrete intake chambers each in fluid communication with the intake port and the particle retaining element, the suction head assembly further having a chamber control mechanism that controls suction through the intake chambers; and a switch in communication with the chamber control mechanism to allow selective operation of the vacuum cleaner in one of at least two modes including:

a default mode wherein suction is applied through all of the plurality of intake chambers; and an activated mode wherein the chamber control mechanism selectively applies suction through each of at least two of the plurality of intake chambers in a predetermined sequence.

18. The vacuum cleaner of claim 17, wherein the chamber control mechanism selectively applies suction through each of the plurality of intake chambers in a predetermined sequence when in the activated mode.

19. The vacuum cleaner of claim 17, further comprising a beater element disposed adjacent to the intake port for facilitating intake of particles through the intake port.

20. The vacuum cleaner of claim 17, wherein the suction head assembly creates suction via a fan and motor assembly disposed therein.

* * * * *